US010513887B1

(12) United States Patent
Drysdale

(10) Patent No.: US 10,513,887 B1
(45) Date of Patent: Dec. 24, 2019

(54) SELF-ELEVATING DRILLING UNIT DRILLS PETROLEUM WELL OFFSHORE WITH WELLHEAD ON SEABED

(71) Applicant: Thomas G Drysdale, Magnolia, TX (US)

(72) Inventor: Thomas G Drysdale, Magnolia, TX (US)

( * ) Notice: Subject to any disclaimer, the term of this patent is extended or adjusted under 35 U.S.C. 154(b) by 0 days.

(21) Appl. No.: 16/174,175

(22) Filed: Oct. 29, 2018

(51) Int. Cl.

| | |
|---|---|
| ***E21B 15/02*** | (2006.01) |
| ***E21B 33/035*** | (2006.01) |
| ***E21B 3/04*** | (2006.01) |
| ***E21B 33/038*** | (2006.01) |
| ***E02B 17/02*** | (2006.01) |
| ***E21B 33/064*** | (2006.01) |
| *E21B 19/06* | (2006.01) |

(52) U.S. Cl.
CPC ..... *E21B 15/02* (2013.01); *E02B 17/02* (2013.01); *E21B 3/04* (2013.01); *E21B 33/035* (2013.01); *E21B 33/038* (2013.01); *E21B 33/064* (2013.01); *E21B 19/06* (2013.01)

(58) Field of Classification Search
CPC . E21B 15/02; E21B 17/02; E21B 3/04; E21B 33/035; E21B 33/038; E21B 33/064; E21B 19/069
See application file for complete search history.

(56) References Cited

U.S. PATENT DOCUMENTS

| | | | | |
|---|---|---|---|---|
| 3,653,435 | A * | 4/1972 | Reistle, III | E21B 33/035 166/366 |
| 3,717,002 | A | 2/1973 | O'Brien et al. | |
| 3,895,677 | A | 7/1975 | Bokenkamp | |
| 3,981,357 | A | 9/1976 | Walker et al. | |
| 6,276,451 | B1 * | 8/2001 | Funk | E21B 33/06 166/77.1 |
| 6,361,251 | B1 | 3/2002 | Soltanahmadi | |
| 6,672,390 | B2 * | 1/2004 | Azancot | E21B 33/038 166/341 |
| 7,073,593 | B2 * | 7/2006 | Hatton | E21B 7/128 166/345 |
| 8,752,637 | B1 * | 6/2014 | Childers | E21B 33/03 166/285 |
| 9,255,446 | B2 * | 2/2016 | Shafer | E21B 33/064 |
| 9,416,600 | B2 * | 8/2016 | Golovinskij | E02B 17/021 |

(Continued)

*Primary Examiner* — Anna M Momper
*Assistant Examiner* — Patrick F Lambe

(57) ABSTRACT

A method and apparatus for drilling wells for producing petroleum products from an earth formation that is covered by shallow water having a depth of about 600' or less, using a self-elevating drilling unit (SEDU) to drill one or more wells having wellheads located at or near the seabed. Well drilling is accomplished through a blowout preventer stack and a drilling spool string having a wellhead connector secured at its lower end and establishing releasable connection with the subsea wellhead. As a plurality of wells are being drilled, production of petroleum products can begin from wells that have already been completed, thus initiating an income stream from petroleum production starting only a few months from initiation of well drilling activity. When a well has been drilled, completed and rendered safe, the drilling spool string and wellhead connector is removed to the SEDU, leaving the wellhead positioned at the seabed in readiness for later production.

15 Claims, 8 Drawing Sheets

(56) References Cited

U.S. PATENT DOCUMENTS

| | | | | |
|---|---|---|---|---|
| 10,273,769 | B2 | 4/2019 | Crow | |
| 2002/0159840 | A1* | 10/2002 | Bennett, Jr. | E21B 15/003 405/196 |
| 2008/0044234 | A1* | 2/2008 | Morrison | E02B 17/0004 405/201 |
| 2013/0101357 | A1* | 4/2013 | Noble | E02B 17/0021 405/196 |
| 2014/0190701 | A1* | 7/2014 | Humphreys | E21B 17/017 166/345 |
| 2015/0034384 | A1* | 2/2015 | Leuchtenberg | E21B 33/064 175/5 |
| 2018/0245411 | A1* | 8/2018 | Piccolo | E21B 33/0355 |

* cited by examiner

SELF-ELEVATING DRILLING UNIT DRILLS PETROLEUM WELL OFFSHORE WITH WELLHEAD ON SEABED

BACKGROUND OF THE INVENTION

Field of the Invention

The present invention relates generally to drilling offshore wells in conditions where the water depth is shallow, such as a well drilling site having a water depth of about 600', more or less. More particularly, the present invention concerns a method or process and apparatus for offshore well drilling using a self-elevating drilling unit (SEDU), with the well or wells being completed with the wellhead located on or near the level of the seabed. More particularly, this invention concerns drilling offshore wells in shallow water conditions and producing the wells after well drilling has been completed or while well drilling other wells is in progress. After completion of the wells, moving the SEDU away from the drilling site and leaving the wellheads of the wells at or near the seabed and at a water depth that does not constitute a navigation hazard.

Description of the Prior Art

SEDU's have been widely used for drilling offshore wells for production of petroleum products, including crude oil, natural gas and water from subsea petroleum bearing formations. SEDU's, also sometimes referred to as "jack-up well drilling units", employ a platform in the form of a seagoing vessel which can be self-powered for movement on the water of a sea or lake, or can be subject to movement and positioning by one or more work vessels. A well drilling rig is secured to and projects upwardly from the platform and is adapted to drill a well from the seabed into the subsurface formation to a petroleum bearing formation for production of petroleum products. A plurality of legs are movably mounted to the platform and have lower ends that are designed to rest on the seabed, thus securing the platform in place at a well drilling site. The legs have lift mechanisms that move the platform upwardly until its hull is well clear of the surface of the water.

Typically, the wells are drilled and are completed with a blowout preventer (BOP) and production tree located above the surface of the sea. To produce the wells a production platform is typically designed and constructed on land and then moved, in floating condition, to the well site and installed. The design and construction phase of a typical production platform can be in the order of three years, and the cost can be several million dollars. More importantly, the drilled and completed wells are shut in upon completion and cannot be produced until the production platform has been installed and outfitted with production equipment.

The wellheads and BOP's during production activities and until the wells are later decommissioned constitute a hazard to navigation. When production of the wells is terminated and the wells are decommissioned and shut in the conductors and well production piping are cut off at a sufficient depth, preferably at the seabed, to substantially eliminate the potential for hazards to surface vessel operation. Thus, the decommissioning process for offshore wells is very expensive. The production platform must also be decommissioned and the platform structure must be removed, adding significantly to the expense of finding and producing petroleum products.

SUMMARY OF THE INVENTION

It is a principal feature of the present invention to provide a novel system and method for using a self-elevating drilling unit (SEDU) for drilling wells in shallow water conditions, i.e., with a water depth in the range of 600' or less.

It is another feature of the present invention to provide a novel method for using a SEDU for drilling one or more wells in shallow water and completing the wells with their wellheads located at the seabed so that no navigation hazards are left at the site after all of the wells have been drilled and the SEDU has been moved to another drill site.

It is also a feature of this invention to initiate the drilling of a subsea well with a conductor pipe penetrating a sufficient depth into the seabed, and with a wellhead located at or near the surface of the seabed, then employ a SEDU for deploying a wellhead connector and a drilling spool string having multiple drilling spools connected end on end and extending to and connected with a surface blowout preventer (BOP) stack located on the SEDU to enable well drilling and completion through the wellhead and drilling spool string It is a feature of the present invention of provide a novel wellhead connector and drilling spool assembly wherein a plurality of drilling spools are connected end to end to comprise a drilling spool string that facilitates well drilling from an SEDU and which can be completely removed upon completion of well drilling and completion to leave a wellhead at or near the seabed to ensure that no structure remains as a navigation hazard.

It is a feature of the present invention of provide a novel drilling spool running apparatus that enables lifting and positioning single drilling spools or a string of connected drilling spools to enable well drilling and for removing drilling spools or drilling spool strings as needed.

Briefly, the various objects and features of the present invention are realized through the provision of a method or process for drilling and completing wells using a self-elevating drilling unit (SEDU) also known as a jack-up rig. The SEDU enables the drilling and servicing of offshore petroleum and/or natural gas (P/NG) with the wellheads of the drilled and completed wells located at or near the seabed. After the scheduled wells have been drilled and completed, the SEDU can be moved away from the drill site, thus leaving the wells with their wellheads located well below any water depth that would cause the wellheads to constitute a hazard to navigation. When a pattern of wells is being drilled by a SEDU, because the wells are completed with their wellheads located at the seabed, wells that have already been drilled can be placed in production while other wells are in the process of being drilled. Flexible risers are used to conduct produced oil and natural gas to a floating production storage offloading vessel which serves to transport the petroleum products to a refinery or other point of sale. When production of the wells has been depleted the wells can be permanently shut in, with the abandoned wellheads located at the seabed constituting no hazard of any kind to navigation or to other personnel or equipment.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is an elevation view of the starboard or right side of a self-elevating drilling unit showing its use in the drilling and completion of conventional offshore wells and is representative of the "prior art";

FIG. 2 is an elevation view presenting the self-elevating drilling unit of FIG. 1 and being an aft view also representing the "prior art";

FIG. 3 is a starboard or right side elevation view showing a conventional self-elevating drilling unit being employed according to the spirit and scope of the method or process for well drilling and completion according to the present invention;

FIG. 4 is an aft or rear elevation view showing further details of the method or process for well drilling and completion using the self-elevating drilling unit of FIG. 3;

FIG. 5 is a section view showing the drilling spool assembly of the present invention in substantially complete form and having a buoyancy module positioned about the tubing structure thereof.

FIG. 6 is a section view showing the upper flange portion of the drill-through welded spool assembly of the subsea wellhead structure of FIG. 5;

FIG. 7 is a section view showing a hydraulically actuated running tool for installation and extraction of the drilling spool shown in FIGS. 5 and 6;

FIG. 8 is a top plan view showing a spider assembly having a part thereof showing its assembly with the upper flange of the drilling spool and having a part thereof broken away and showing the hydraulically actuated dogs of the spider assembly; and FIG. 9 is a view showing the spider assembly in section and showing the drilling spool in full line.

DETAILED DESCRIPTION OF PREFERRED EMBODIMENT

The present invention is directed to a drilling system for a self-elevating drilling unit (SEDU) to drill subsea petroleum/natural gas (P/NG) wells. Subsea wellheads are typically owned by a wellsite operator which is typically an energy company that produces crude oil and natural gas (P/NG) from a subsurface production formation and sells the produced energy products to other energy organizations. The subsea wellhead assembly under consideration concerning this invention is typically of an H4 profile type that is most commonly used for drilling subsea P/NG wells. The subsea wellhead assembly is either installed by a self-elevating drilling unit (SEDU) or by some other marine vessel prior to the arrival of the SEDU at the drill site. The subsea wellhead is a permanently installed assembly on the seabed. This wellhead assembly serves as a connection point for the SEDU drilling system. The wellhead assembly also serves as a connection point for well production tree assemblies upon completion of the P/NG well construction.

Figure 1:
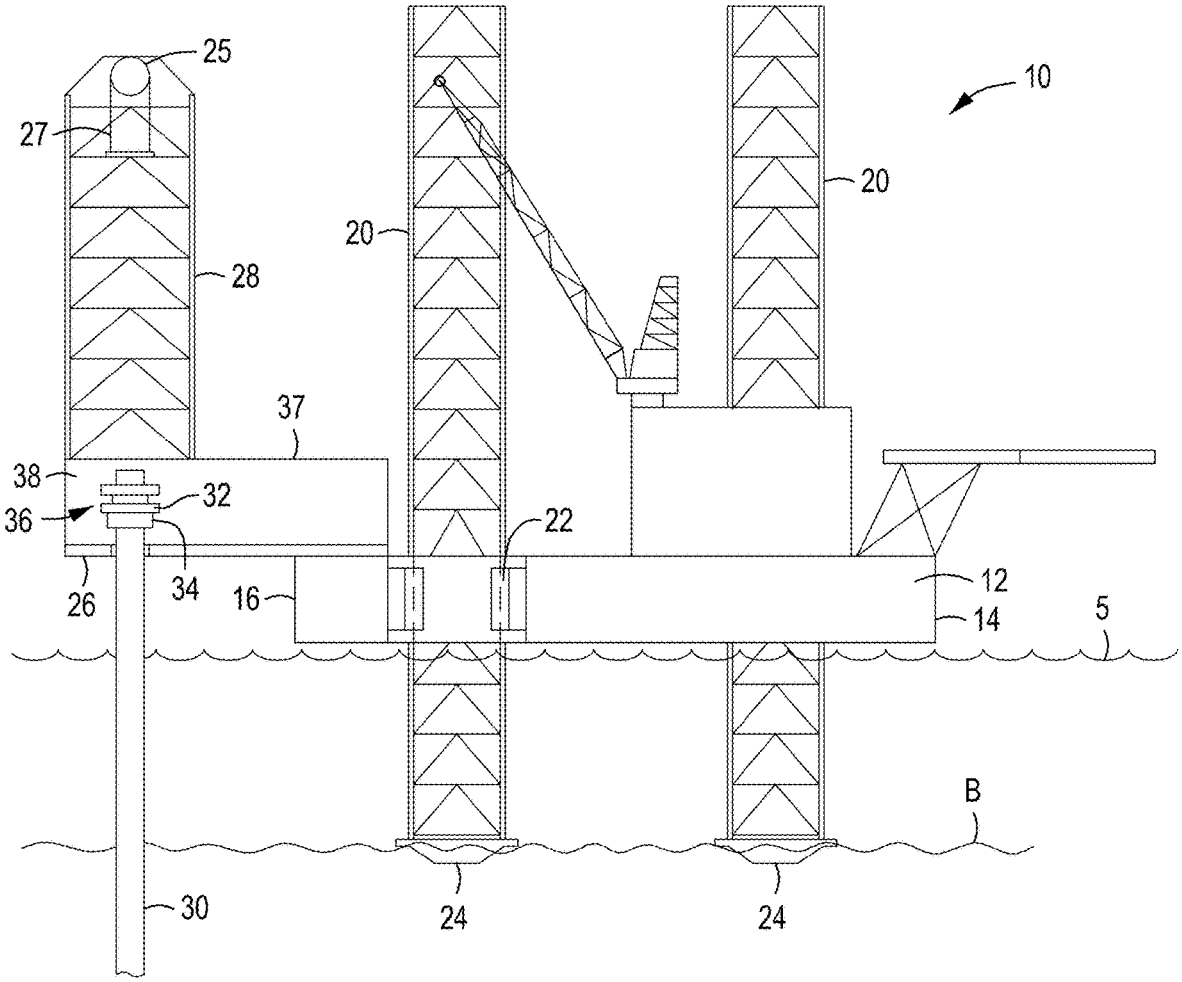
FIG. 1 (PRIOR ART)
Figure 2:
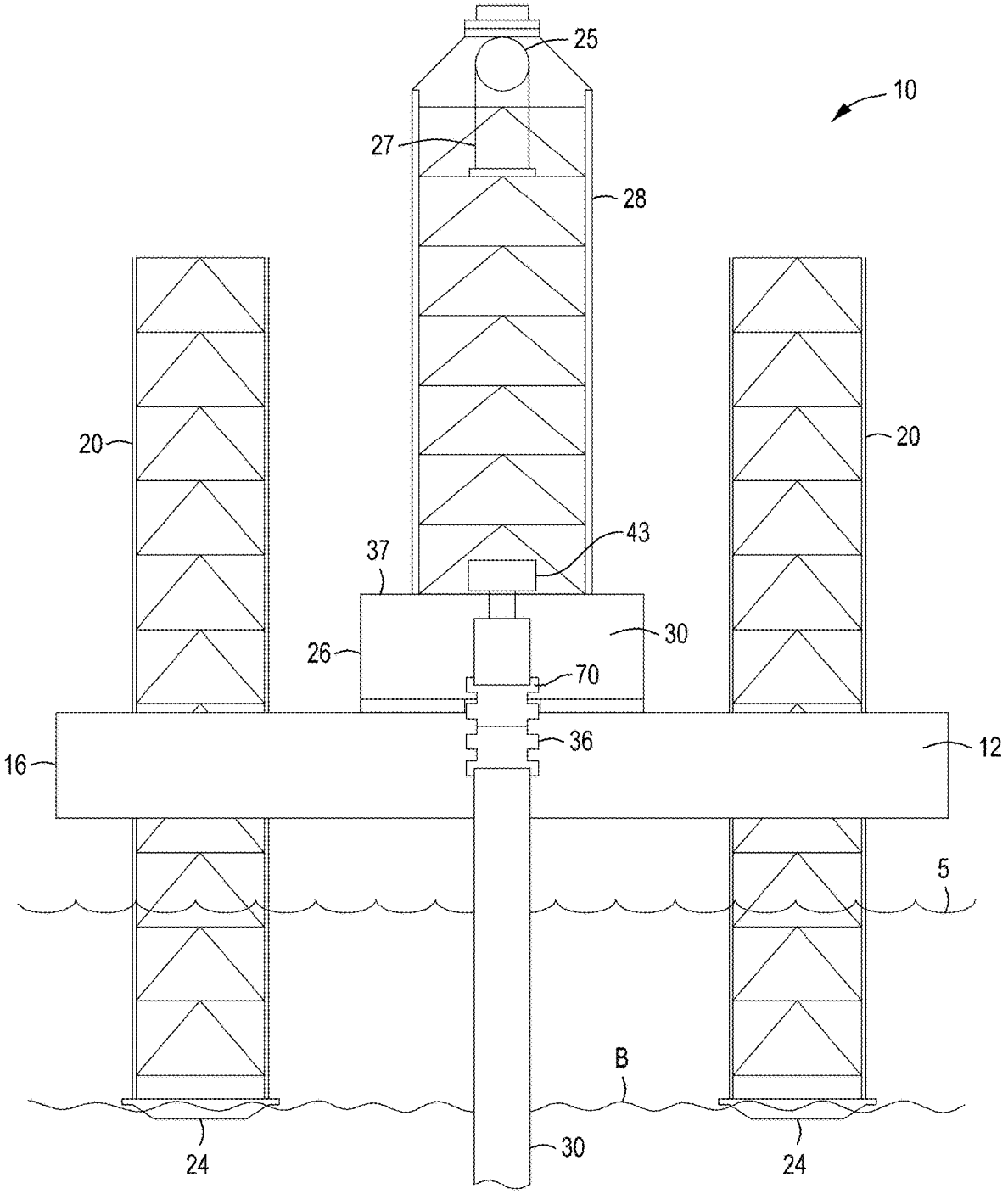
FIG. 2 (PRIOR ART)

Referring now to the drawings and first to FIGS. 1 and 2, which represent the "prior art" as indicated on the drawings, a self-elevating drilling unit (SEDU) is shown generally at 10 and incorporates a vessel hull 12 having a bow 14 and stern 16. The SEDU 10 can be of the self-powered variety enabling it to move to or from a site by means of on-board power equipment. Alternatively, the vessel 10 can be designed to rely on work boats for moving it to or from a site. The vessel hull 12 defines through-hull receptacles, such as shown at 18 in FIG. 1, to permit movement of support leg members 20. Apparatus 22 for moving the support leg members upwardly or downwardly within the through-hull receptacles 18, also known as leg jacking apparatus, is well known in the art. After the SEDU has been positioned at a selected location for well drilling activity, the support leg members 20 are moved downwardly relative to the hull 12, causing support plates 24 at the lower ends of the support legs to contact the soil at the seabed B. Further downward movement of the support legs by the jacking mechanism will force the support plates 24 of the support leg members 20 a sufficient distance into the mud of the seabed "B" until more consolidated seabed soil is encountered that will support the weight of the SEDU. Further jacking movement of the support legs 20 will raise the vessel hull 12 to a desirable height above the sea surface "S" so that drilling operations and various other well service activities will not be compromised by sea water, wave action, etc.

The vessel hull 12 is provided with a cantilevered drilling platform structure 26, typically extending beyond the stern 16 of the vessel hull 12, which provides support for a drilling rig derrick 28 and various other conventional well drilling apparatus. The derrick 28 has a conventional top drive 25 and pipe elevators 27 for lifting and lowering pipe and other drilling rig apparatus. Conventionally, during initial well drilling activity as shown in prior art views of FIGS. 1 and 2 a conductor pipe 30 is installed to a desired depth in the seabed and subsurface earth formation and extends upwardly to the lower portion of the cantilevered drilling platform structure 26 and is provided with a mounting flange 32 and a wellhead 34 that are located immediately below the main deck or rig working floor 37.

According to the conventional drilling method, a blowout preventer stack (BOP) is shown generally at 36 in FIGS. 1 and 2 is mounted to the wellhead 34 and is located within a chamber 38 of the cantilevered drilling platform structure 26. After the well has been drilled and completed and rendered safe the BOP stack 36 can be removed from the wellhead. The conductor casing and wellhead above the mudline on the seabed is removed by mechanical cutting. A corrosion cap is fitted to the casing at the mudline. The constructed well with corrosion cap will remain until such time as a bottom standing production platform can be designed, constructed and installed. During this period of time the well will not be capable of producing.

Figure 3:
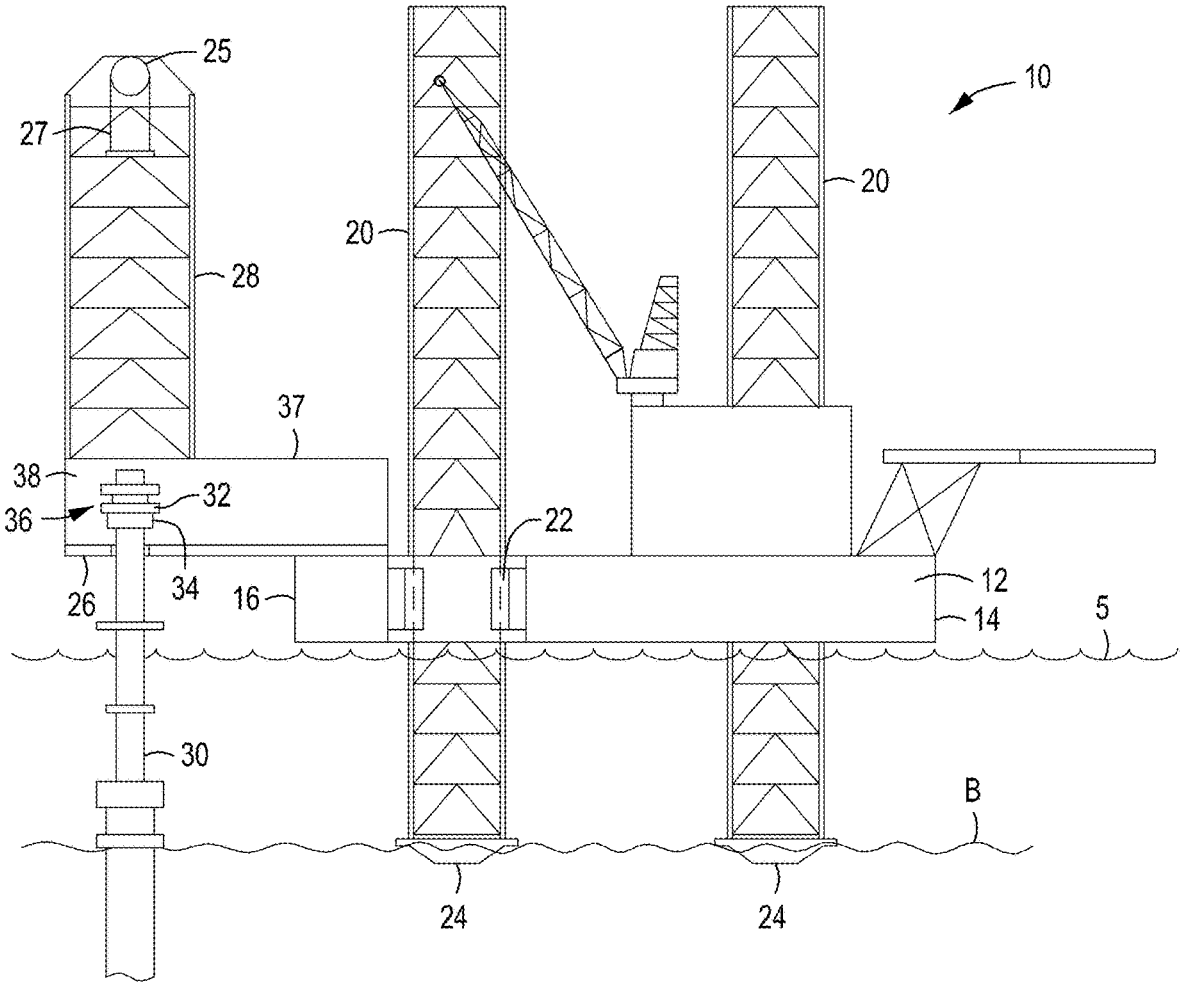
Figure 4:
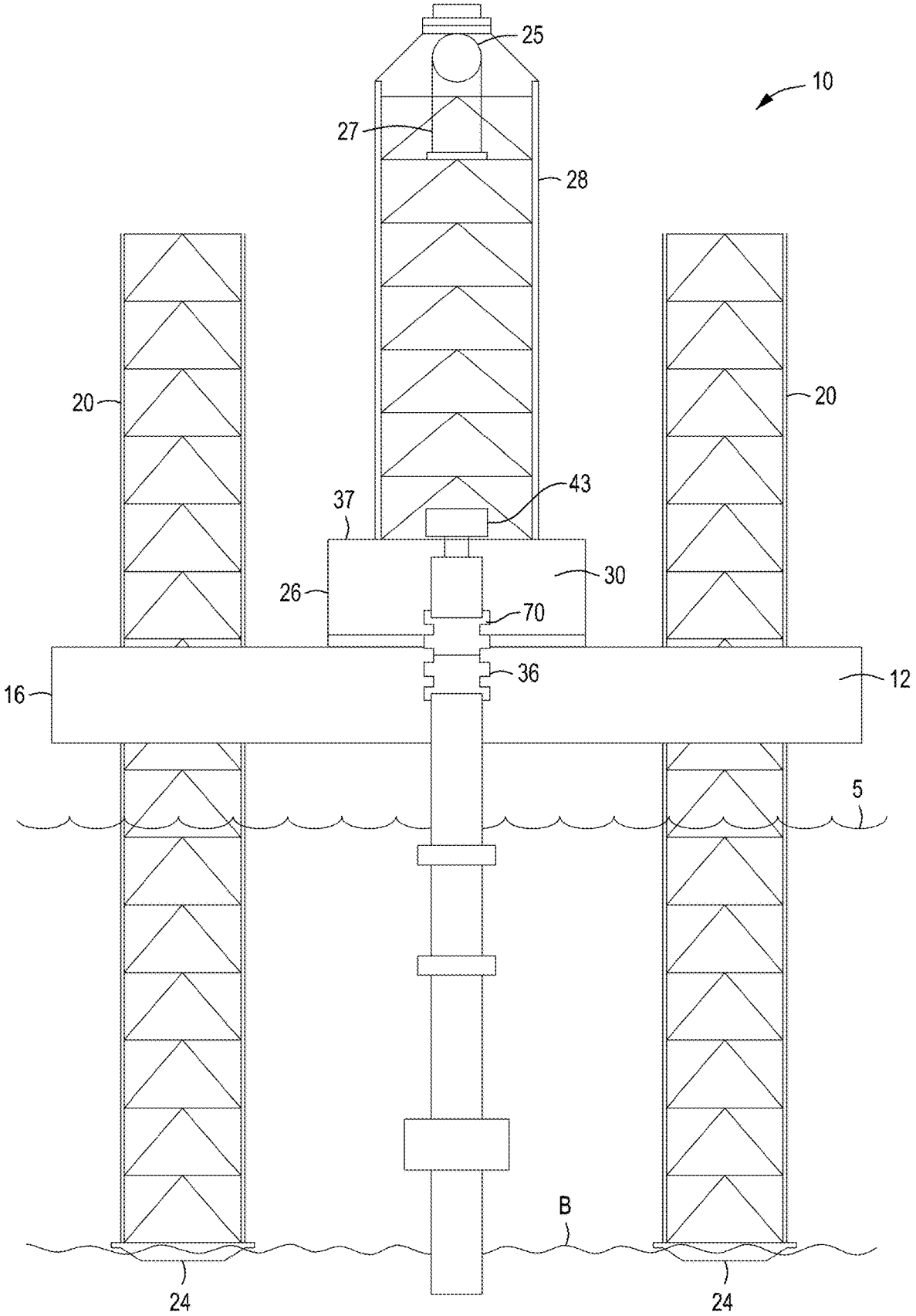

FIGS. 3 and 4 show a substantially conventional SEDU being used according to the method and employing the apparatus of the present invention for drilling and completing offshore wells with wellheads located at or near the seabed. This process eliminates the need for designing, fabricating and installing more permanent production platforms, thus saving time and investment and permitting the wells to be placed in production in a few months time after completion rather than requiring one or more years before production can begin.

According to the starboard elevation view of FIG. 3 and the aft or stern view of FIG. 4 the drilling spool string 41 is shown to be provided with a subsea wellhead connector 40 to is mounted a subsea wellhead mechanism 42. Typically, the wellhead connector 40 will have a size range of about 18-15 M, (API 18¾" ID, 15,000 psi rating) though it can be of any suitable size that is appropriate for an intended subsea well installation. A plurality of 18-15M drill-through spools 41, which may be of the same or differing lengths, are connected end on end from the wellhead connector and extend to a level above the water surface accommodate the depth of the water within which the drilling operation is being conducted and the height of the SEDU above the water surface. A BOP stack shown generally at 36 is mounted to the uppermost drilling spool 44 and is located in a chamber 38 of the cantilevered vessel deck structure 26. A skid mechanism 25 is provided at the lower portion of the chamber 38 of the cantilevered vessel deck structure and is capable of moving heavy objects such as a BOP stack, drilling spools and drilling spool strings within the chamber 38, such as for alignment with the rotary drilling table 43 or for movement to a storage section of the chamber. The cantilevered vessel deck structure defines a rig floor 39 where workers are typically situated during a well drilling process. The maximum jack-up operating depth is specified by the jack-up MODU designer and the American Bureau of Shipping Class Society.

The SEDU drilling system of the present invention consists of a deployable and retrievable subsea wellhead connector 40, drilling spools 41, surface blowout preventer (BOP) stack 36 and a diverter assembly. Subsea connectors that are suitable for this drilling system exist at the present time. A subsea 18¾", 15,000 psi rated wellhead connector 40 is hydraulically operated and has wellhead connector functions, namely "lock", "unlock", "auxiliary unlock", "gasket retain" and "gasket release". The hydraulic control system for the wellhead connector is located on the SEDU and has a hydraulic hose bundle supplying the hydraulic energy for functioning from the control system to the subsea wellhead connector 40. The individual hoses in the hose bundle, or umbilical, are connected to subsea wellhead connector control ports prior to deployment subsea. The umbilical is deployed and retrieved by an air powered hose reel on the SEDU aft main deck. Some options for controlling the functions of the wellhead connector are by means of a remote operated vehicle (ROV) and acoustic signal operated hydraulic control pod.

The top outlet on the wellhead connector 40 is a studded or flanged 18¾", 15,000 psi, (18-15M), API standard flanged connection 45 at its upper end. A short length 18-15M drilling tube 44 with an 18-15M flange connection 46 on the bottom and an 18-15M studded connection 47 on the top would be joined by bolting to the top of the wellhead connector 40. The drilling spool 41 is of sufficient length to accommodate a conventional retrievable 18-15M test plug (not shown). The inside diameter of the short 18-15M drill-through spool 41 is preferably 18.750 inches throughout its length, though if desired the inside diameter can be larger or smaller according to the design of the drill-through system. A string of longer length 18-15M drilling spools, shown generally at 43, are joined end to end and to the wellhead connector 40 and short spool assembly 41 of FIG. 5 to span the vertical distance from the wellhead connector to the bottom connector of the 18-15M BOP stack 36 of FIGS. 3 and 4. The 18-15M BOP stack 36 is located above the sea surface in a chamber 38 located inboard of the cantilevered drilling platform structure 26 and below the rig floor 39.

Figure 5:
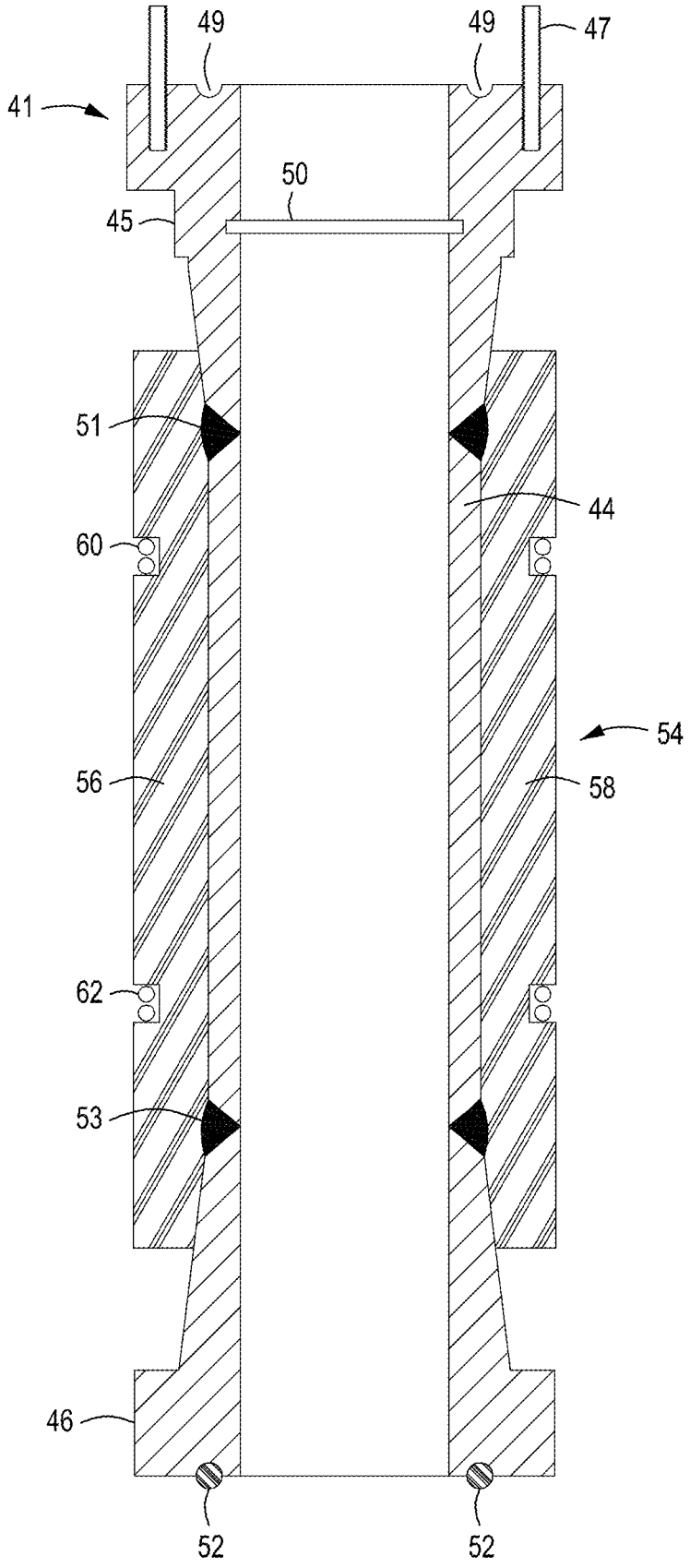
Figure 6:
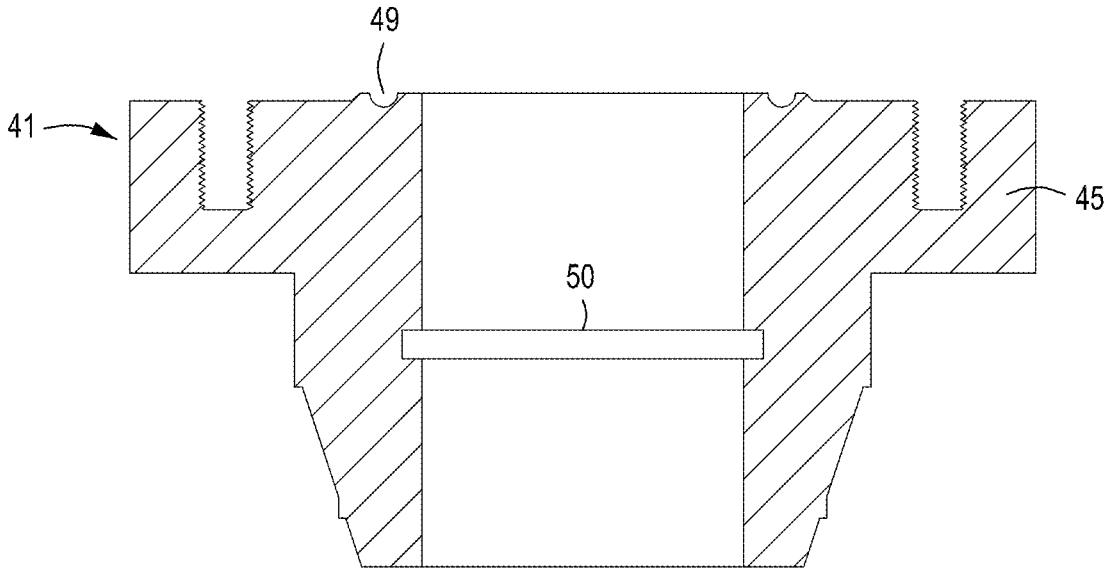

Each of the 18-15M drilling spools preferably consists of a high strength steel tube 44 of desired length with an inside diameter of not less than 18.750 inches and API standard end connection flanges as shown in FIG. 5. The lower 18-15M flange 46 is a flange type connection having a ring gasket groove 48 receiving a standard API metallic gasket (not shown). The upper end of the drill-through spool 41 is an 18-15M studded type flange connection having a ring gasket groove 49 also having a standard metallic ring gasket for sealing the flange 46 to an adjacent connection flange of the wellhead or any other tubular conduit system. The upper end flange also has an internal circular groove 50 machined therein and located a short distance above the weld joint end 51. The addition of this circular groove requires some modification to the length and wall thickness of a standard 18-15M weld neck flange. The internal circular groove 50 is provided for spool handling purposes as will be discussed later in this drilling system description. The tubular member 44 if the drilling spool 41 is joined to the upper and lower flange connections 45 and 46 by full penetration welding as shown at 51 and 53 in FIG. 5. These drilling spools fully comply with the manufacturing requirements for drilling spools as set forth in *Specification for Drill-through Equipment, ANSI/API* 16*A*, current edition.

To provide the drill-through system of the present invention with buoyancy to offset the effective weight of the string 81 of drill-through spools 41, buoyancy modules shown generally at 54 are attached to the individual drilling spools to create a vertical uplifting force on the deployed drilling spool string. The buoyancy modules are molded in lengthwise halves, such as shown at 56 and 58 in FIG. 5 and are secured around the tubular length of each drilling spool by means of bolts 60 and 62. The molded buoyancy material is a low-density syntactic foam with a fiberglass exterior skin. The buoyancy modules 54 may be formed of any other suitable buoyant material within the spirit and scope of this invention. The upper end of the drilling spool string 81 terminates with an 18-15M drill though mandrel (not shown) having an 18-15M flange connection on the bottom and a male H4, or some other, profile shape at its top. The mandrel engages an 18-15M connector at the bottom of the surface BOP stack 36.

The BOP stack assembly 36 consists of an 18-15M hydraulic connector 64 at the bottom, at least two ram type 18-15M blowout preventer units 66 and 68 and one 18-10M annular type blowout preventer unit 70 at its top as shown in FIG. 4. Choke and Kill system valves 72 are mounted on the side outlets of the ram type blowout preventer units. The BOP stack assembly 74 is suspension supported by a stack lift ring. The lift ring is attached to hydraulic cylinders beneath the rig floor. These cylinders provide tension and support to the BOP stack, the spool string 81 and the wellhead connector 40. The top outlet of the annular BOP is joined to the bottom of the diverter system 76 by 21¼" tubular members. The diverter assembly 76 is landed in a diverter support housing 77 to complete the drilling and mud circulation system.

Prior to deployment subsea, the major components of the drilling system are prepared in the following manner: The subsea wellhead connector 40 is joined by bolting to the aforementioned 18-15M short drilling spool 41. Above the short drilling spool one or more 18-15M drilling spools 44 of any desired length to accommodate the space between the subsea wellhead and the bottom connection flange of the BOP stack are joined by bolting. The drilling spool assembly operation is performed on the SEDU main deck cantilever area that is located under the rig floor and pipe rack. This bolted drill-through drilling spool assembly is lowered and locked onto a test stump (not shown) for pressure testing. A test stump is a conventional and currently available testing mechanism that has the same H4 profile as the wellhead for ease of drilling spool assembly and disassembly and has a blind end to permit internal pressurization during testing.

The upper end of the bolted drill-through conduit assembly has a blind test flange bolted onto it during the testing process. The overall height of this bolted drill-through conduit assembly does not interfere with the cantilever skidding movement of the skid mechanism 45. This bolted drill-through conduit assembly preferably has its wellhead connector functions tested in advance so as to be immediately available for deployment when needed. Also, for the purpose of testing the drilling spool assembly's wellbore is filled with water as a test fluid. A hydrostatic test at 15,000 psi rated pressure and a low-pressure test is performed and documented to prepare the bolted drill-through drilling spool string 81 for use during well drilling activity. On later generation SEDU rigs that are equipped with dual activity derricks, the drilling spool strings are preferably assembled in lengths and stored in the offline setback area of the derrick. These assembled drilling spool stands are preferably hydrostatically tested prior to deployment. Otherwise, the individual longer length drilling spools are deployed as singles.

Prior to deployment, the BOP stack assembly is locked onto the 18-15M mandrel and a second short drilling spool assembly. A test flange is bolted onto the bottom of the mandrel-spool assembly for testing purposes. All BOP stack wellbore and Choke and Kill functions are hydrostatically tested at rated pressure and low-pressure conditions. The diverter assembly 76 is tested prior to drilling operations according to test specifications prescribed and agreed upon by the rig owner and the offshore lease operator.

At this phase of the offshore well drilling process the SEDU is positioned at the wellsite and the SEDU leg members 20 are extended down into the seabed sufficient to provide for support of the SEDU. The preload/ballasting operation of the SEDU has been completed. The SEDU is elevated to operational height above the sea surface by moving the leg members 20 downwardly relative to the vessel hull 12. The subsea wellhead assembly including the conductor pipe 30 and wellhead 34 has been installed in the seabed. The BOP stack is in its stowed position. The diverter assembly has been removed from the diverter support housing. The cantilever structure 26 is skidded in at this time.

To begin deployment of the drilling system down to the subsea wellhead, the first operation is to position the wellhead connector and drilling spool assembly on the main deck directly below the bottom opening of the diverter support housing. The diverter assembly and support housing are mounted below and in line with the rotary table. The top surface of the rotary table is located in the same horizontal plane as the rig floor surface.

Figure 7:
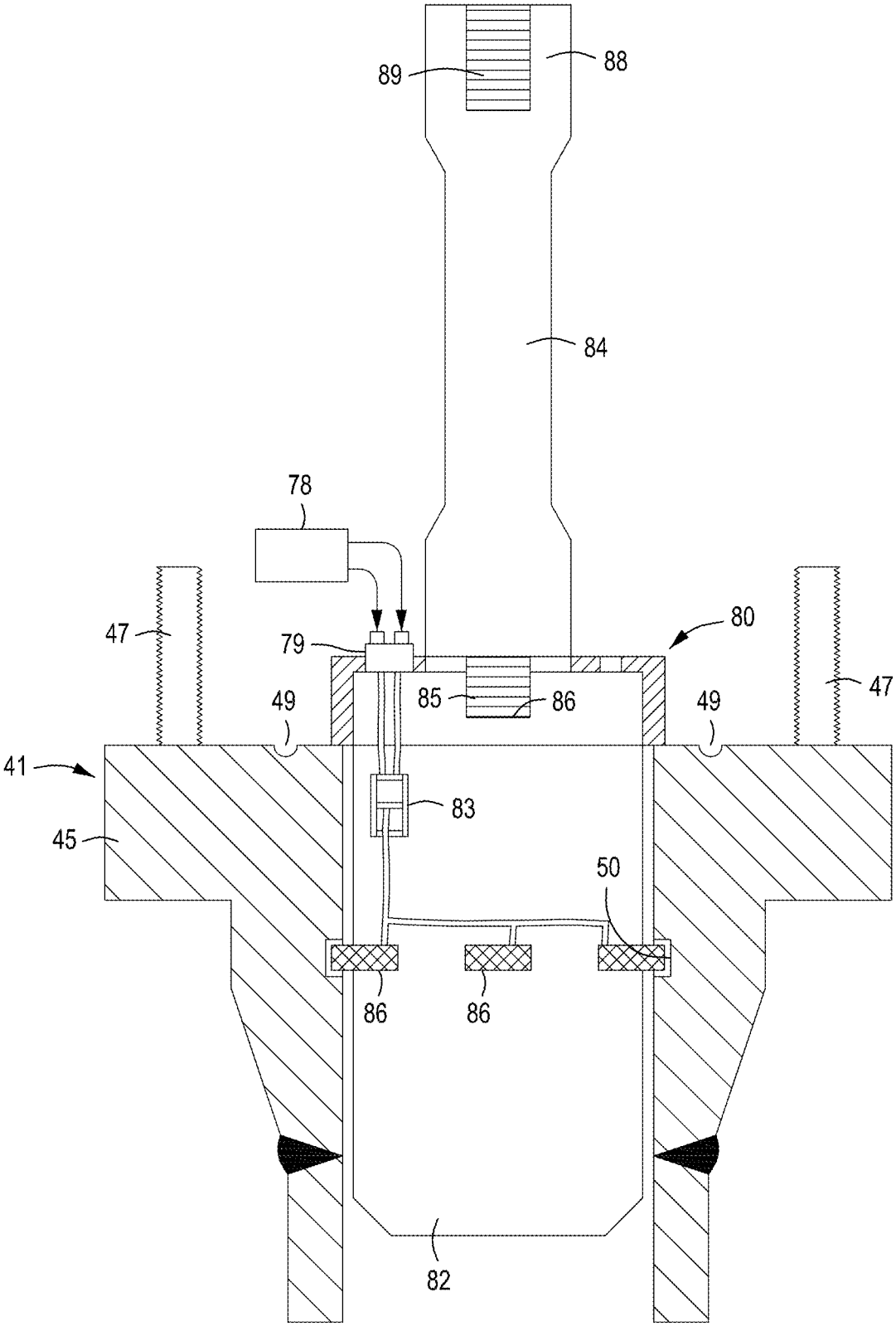

In order to accomplish simple and efficient handling of the drilling spools a drilling spool running tool shown generally at 80 is used to lift individual drilling spools, as well as drilling spool string assemblies and move them as needed. This running tool engages within the internal groove 50 of the upper studded end of a drilling spool 41 as previously discussed in this system description. The drilling spool running tool 80 consists of a running tool body 82 and a lifting stem 84. The body 82 of the drilling spool running tool 80 has a number of locking dogs 86 that are extended horizontally from the running tool body 82 to locking positions engaged within the circular internal drilling spool groove 50. The locking dogs 86 are actuated to extended locking positions within the drilling spool groove 50 and retracted positions disengaged from the circular internal drilling spool groove by a hydraulic actuator having a vertically acting hydraulic piston 83 in the tool body 82. The hydraulic actuator piston 83 is controlled by a hydraulic system 78 having a hydraulic port selector 79 for controlling hydraulic fluid communication to "extend" and "retract" ports as shown in FIG. 7. The lifting stem 84 has a threaded drill pipe pin connection 85 at its lower end that is threaded into an internally threaded drill pipe box connection 86 of the running tool body 82. The lifting stem 84 has a drill pipe box end at its upper end to facilitate connection of a drill pipe extension thereto in the event such is needed. The pipe elevators of the top drive of the derrick would latch around the lifting stem 84 for hoisting. The internally threaded lifting stem box end 88 has an internally threaded upwardly facing box connection thread 89 that permits a standard joint of drill pipe to be threadedly connected with said lifting stem and employed as an extension to the lifting stem of the running tool.

The running tool assembly with a drill pipe extension of the appropriate length would be latched onto the elevators. The running tool assembly is lowered through the rotary table opening and on through the diverter support housing. The wellhead connector 40 with its string 81 of drilling spools at this point will be standing on the main deck below the diverter support housing bottom opening. The running tool is engaged in the internal groove 50 of the uppermost drilling spool of the drilling spool string. The wellhead connector 40 and drilling spool string assembly is then hoisted until the top studded flange 45 of the uppermost drilling spool of the drilling spool string is positioned above the rotary table 91.

Figure 8:
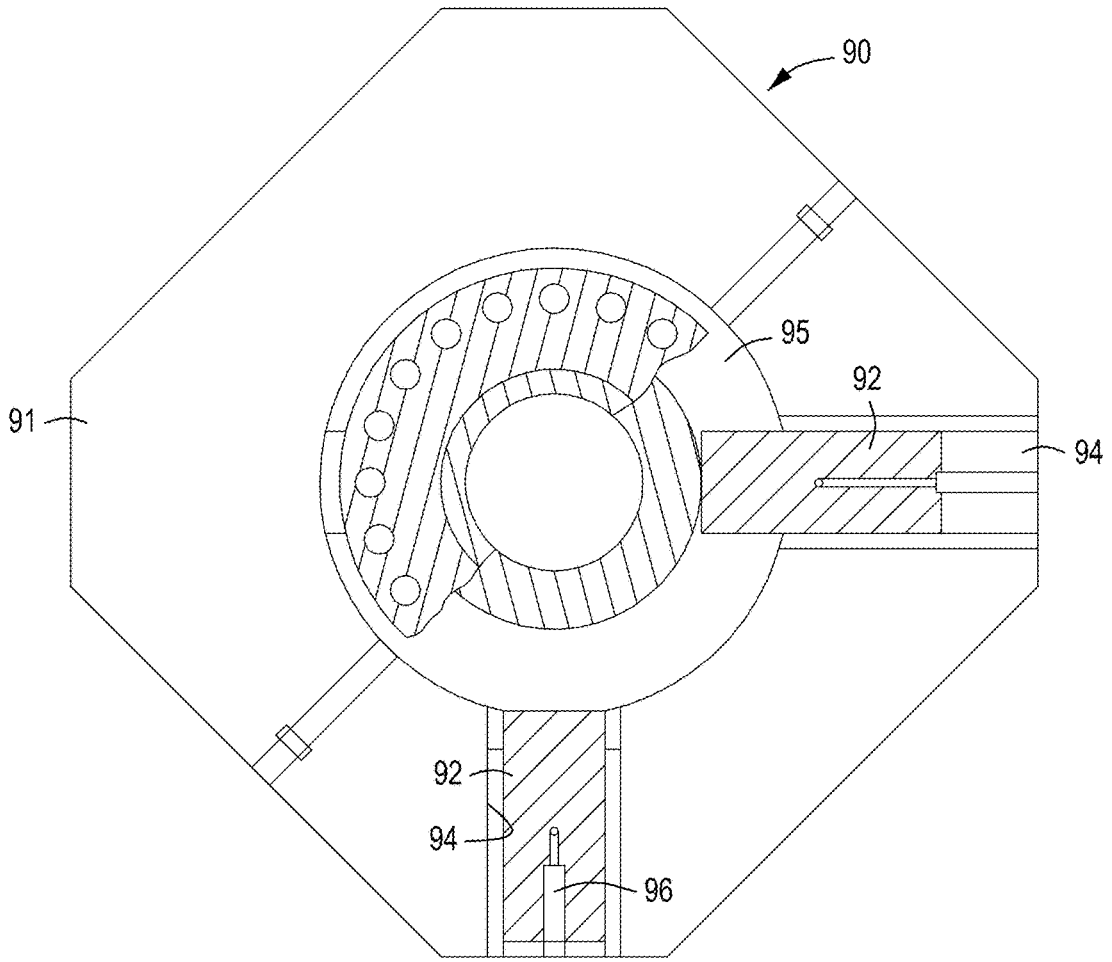
Figure 9:
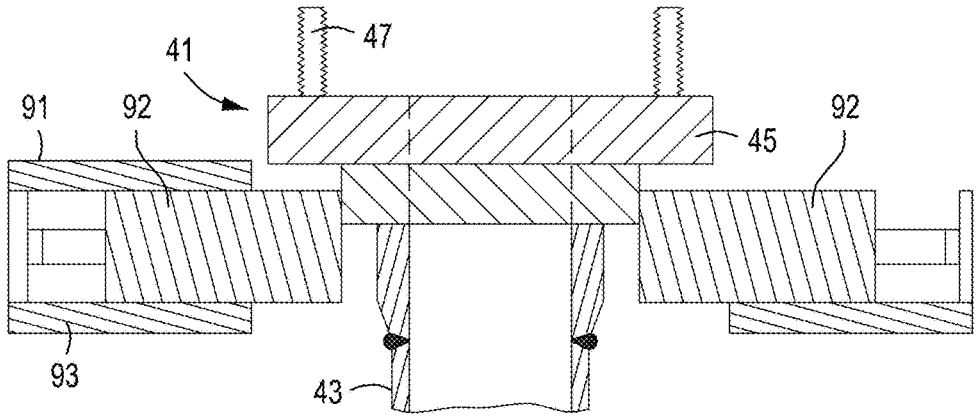

A support spider assembly, shown generally at 90 in FIGS. 8 and 9, is situated on the rotary opening 87 of the rig floor 39 as shown in FIG. 4. A support spider is a device that has moveable support dogs 92 that extend and retract within pockets 94 within the spider weldment relative to its central opening 95. The spider dogs 92 are hydraulically moveable within spider dog pockets 94 of the spider weldment by hydraulic actuators 96. With the spider dogs 92 retracted, each of the drilling spool flanges 45 and 46 of the drilling spool 41 of FIG. 5 can pass through the spider opening. When the spider dogs 92 are hydraulically extended as shown in FIG. 9, the drilling spool string 81 can be lowered by the elevator of the derrick to rest on the support spider. Support spider 90 has upper and lower generally parallel body plates 91 and 93 between which the spider dogs 92 are moveable within pockets 95 to their extended and retracted positions. It should be observed that FIG. 9 shows the drilling spool 41 in downward movement toward its seated and supported position by the spider assembly 90. When fully seated and supported by the spider assembly the connection flange 45 at the upper end of the drilling spool 41 will engage and be supported by the spider dogs 92. When the drilling spool or drilling spool string is supported by the spider assembly the drill pipe extension on the running tool 80 can be removed. The elevators 27 of the derrick 28 are now latched onto the running tool lifting stem 84. The SEDU cantilever structure is now skid extended aft. The position of the rotary table opening 87 is close to, but not directly over, the subsea wellhead 34 on the seabed "B".

The drilling spools 41 are bolted to one another to form a drilling spool string 81 in the following manner. The drilling spool running tool 80 is disengaged from the spool string 81 in the spider 80 by retracting the locking dogs 86 from the circular internal groove 50 of the uppermost drilling spool. The running tool 80 is engaged within the central passage of the next drilling spool 41 to be added and after moving the locking dogs 86 within the internal circular locking groove of the selected drilling spool the pipe elevators 27 of the derrick 26 are employed to hoist the selected drilling spool above the spider 80. The individual spool, or a string of drilling spools, is lowered onto the studded flange 45 of the next lower drilling spool with a metal ring gasket 52 in place. The nuts are threaded onto the studs 47 and torqued properly. The drilling spool string 81 is hoisted a short distance to allow the spider dogs to be retracted. The drilling spool string is lowered until the uppermost studded flange is again within a short distance above the spider. The spider dogs 86 are again extended and the drilling spool string is lowered to rest on the spider. The running tool 80 is disengaged from the drilling spool string 81. Another length of drilling spool(s) is engaged to the running tool 80 and added to the drilling spool string 81 in the same manner as previously detailed above.

All the bolted 18-15M spool connections above the lowermost short spool adjacent to the wellhead connector are hydrostatically tested at some point during the deployment operation. One testing option is to run and set a retrievable test plug in the short 18-15M spool just above the wellhead connector. The most cautious approach is to perform a hydrostatic test on the deployed 18-15M string each time it is landed on the spider. The spool string is filled with seawater for pressure testing. An 18-15M blind test flange is fitted to the studded top flange of the drilling spool string. A hydrostatic test is then performed. Following a successful test, the blind flange is removed.

The frequency of hydrostatic testing during deployment is determined by the wellsite operator oil/gas company and the rig owner. As a minimum, the deployed drilling system must pass a 15,000 psi test from the uppermost BOP ram cavity to the wellbore below the subsea wellhead. Once the pressure containing integrity in the wellbore of the deployed drilling system has been confirmed, drilling operations can commence.

The last, or uppermost, drilling spool 41 that is deployed will have the 18-15M mandrel already bolted onto the mounting studs 47 of the studded top flange 45 of the drilling spool 41. An extension joint of drill pipe (not shown) can be added to the lifting stem 84 of the running tool 80 by having its pin connection threaded into the box connection of the lifting stem. The running tool total length would be sufficient to allow the subsea wellhead connector 40 and drilling spool string 81 to reach the subsea wellhead 42.

The cantilever structure 45 of the SEDU would now be skidded horizontally to position the wellhead connector 40 and drilling spool string 81 directly above the subsea wellhead 34. A remote operated vehicle (ROV), operated from the SEDU or another vessel, is employed to visually confirm proper positioning of the rig structure over the subsea wellhead. The wellhead connector and drilling spool string 81 are lowered onto the subsea wellhead by the rig's hoisting system. The wellhead connector "lock" function is hydraulically actuated from the surface mounted system. The ROV located near the seabed visually confirms the wellhead connector's locking indicator to be in "lock" position. A vertical pulling load is then applied by the hoisting system to confirm that the connector is indeed fully locked onto the subsea wellhead. The running tool is now disengaged from the drilling spool string. The drilling spool string 81 is now standing alone. The spider 90 is removed from the rotary table opening and stowed. Next, the BOP stack assembly 65 is moved into position above the 18-15M mandrel and is lowered onto the mandrel. The hydraulic stack connector of the BOP stack assembly is hydraulically locked. The stack connector locking indicator is visually confirmed to be in "lock" position. A vertical upward pulling load is applied to the BOP stack to confirm that the stack connector is locked.

The drilling system is now supported by the BOP stack lift ring and the vertical tension hydraulic cylinders. As previously noted, the tension hydraulic cylinders are mounted on the bottom facing surface of the rig floor structure. Their location is adjacent to the bottom opening of the diverter support housing. The working stroke of the tensioner cylinders exceeds the engagement, or swallow, vertical length of the wellhead connector onto the wellhead. The Choke and Kill line 15,000 psi rated flexible hoses have been connected to the side outlet 3-15M connections on the BOP stack by this phase of deployment. The tubular members that connect the top opening of the BOP stack's annular BOP to the diverter system are now installed. This operation completes the installation of the drilling and mud circulation system.

The retrievable test plug would now be removed from the bottom of the drilling spool string. If deemed necessary, a drift tool of API standard outside diameter is lowered on a drill pipe string through the rotary table opening down through the BOP stack, drilling spool string, wellhead connector and subsea wellhead. This operation confirms the correct inside diameter of the drilling system. The drift tool and pipe string are removed.

For testing of the entire well drilling system prior to drilling operations a retrievable test plug is run into the wellbore and is set a short distance below the subsea wellhead 34. A hydrostatic pressure test is performed in the manner described above to confirm the sealing integrity of the drilling system at rated pressure and low pressure. Upon successful completion of this test operation, the retrievable test plug is removed from the wellbore and brought back to the rig floor surface. The seawater in the wellbore of the drilling system is now replaced with drilling mud fluid. Drilling operations can now commence.

The SEDU is capable of drilling more than one P/NG well at the same location. The rectangular horizontal area within which subsea wellheads can be drilled is defined by the SEDU cantilever extension length and the port to starboard distance the rig floor can be skidded laterally. The installation of multiple subsea wellheads at one location could be performed by the SEDU or by some other vessel. With multiple subsea wellheads present within the defined accessible area, sequential drilling of the wells could be completed with only one deployment operation of the aforementioned drilling system. Preparations for this operation would be enacted prior to the first deployment of the drilling system.

The length of the spool string would be calculated such that the landing and latching of the BOP stack would occur at near maximum extension length of the BOP stack tensioner cylinders. This manipulation of the spool string length is accomplished by the use of short length drilling spools. These are commonly called pup length spools.

Upon completion of drilling and well construction at the first well, preparations are made to move the drilling system to the next subsea wellhead at the location. The completed well is made safe by cementing the wellbore and by the addition of wellbore plugs. The wellbore drilling mud fluid is replaced by seawater. Disconnection of the drilling system from the first well is now safely possible.

To allow vertical movement of the BOP stack and spool string, diverter system components are removed from above the BOP stack. The BOP stack and spool string are still supported by the BOP stack lift ring and tensioner cylinders. The drilling spool running tool 90 with a drill pipe extension is lowered through the BOP stack and engaged in the uppermost internal groove in the drilling spool string. The hoisting elevators are latched onto the running tool extension. This is a second means of vertical support for the BOP stack and drilling spool string in addition to the lift ring and hydraulic cylinders. The wellhead connector 40 is now unlocked by its hydraulic control system. The ROV confirms the connector indicator rod to be in the "unlock" position.

The BOP stack, spool string and wellhead connector assembly can now be moved vertically by the tensioner cylinders with assistance from the rig hoisting system. The ROV would visually confirm that the wellhead connector 40 has clearance above the subsea wellhead 34 of the completed well.

The skidding system 45 would move the rig floor package laterally over the next wellhead to be drilled. Correct positioning of the wellhead connector 40 after skidding would be visually confirmed by the ROV. The BOP stack assembly 74, spool string 81 and wellhead connector 40 assembly is then lowered onto the next subsea wellhead. The wellhead connector 40 is then locked by its hydraulic control system. The "Locked" condition of the wellhead connector is confirmed visually by the ROV as before. A vertical pulling load is then applied by the hoisting system to confirm that the connector 40 is indeed fully locked onto the subsea wellhead. The running tool is disengaged from the spool string 81 and removed. The BOP stack lift ring and tensioner cylinders once again support the BOP stack and spool string.

The retrievable test plug is now run with drill pipe into the wellbore and is set a short distance below the subsea wellhead. A hydrostatic test would be performed at this time. This test demonstrates the pressure retaining integrity of the BOP system from top to bottom. The test would be performed at rated pressure of the drilling system, as well as low pressure. The diverter and associated tubulars would next be reinstalled. The diverter system is made ready for drilling and properly tested. The BOP stack is operationally tested prior to drilling. The seawater in the BOP stack and spool string is replaced by drilling mud fluid. Drilling of the second well at the location can now begin. In the manner described above, all the subsea wellheads at one location could be sequentially drilled by the SEDU so equipped to do so.

This drilling system for a SEDU to drill subsea wells as detailed above could be field installed on high specification SEDU vessels currently in service. This drilling system is an addition to, rather than a replacement of, the conventional drilling system in service on most high specification SEDU vessels at the present time. A shipyard visit by the SEDU for installation of this drilling system for subsea wellheads would likely not be necessary. A SEDU so equipped with this subsea wellhead drilling system could conceivably switch back to conventional well drilling mode if desired. The portability of this subsea wellhead drilling system is another significant feature to be considered.

Operation:

A SEDU 10 is moved to a site of interest and its hull is lifted above the surface of the water and above the surface of the seabed by action of the support legs 20. One or more wells are drilled and completed, with the wellhead of each well being located at or near the seabed "B" and with the BOP stack of each well located within the chamber 34 of the cantilevered structure as the well is being drilled. When a drilled well is rendered safe, the BOP stack and wellhead connector can be removed and the drilling spools and wellhead connector 44 can also be removed, thereby leaving the wellhead in a safe condition at the seabed, well below a depth where it might constitute a hazard to navigation.

If warranted by the petroleum discovery, other wells may be drilled and similarly completed with their wellheads located at the seabed. If desired, some of the wells that have been completed may be placed in production by positioning a floating offshore storage offloading vessel (FPSO) and connecting the wells to the FPSO by means of flexible production risers. This can be done simultaneously with continuation of drilling activities for other wells of a multi-well subsea structure. It is not necessary or appropriate to design, fabricate and install a bottom supported production platform, so considerable initial savings of money and time result from the practice of the present invention.

Advantages:

No structure above mean sea level is necessary to produce P/NG from offshore wells. This is a very significant improvement for modern shallow water P/NG production. The technology necessary to produce P/NG on subsea well installations already exists. After some, or all, of the subsea wells are drilled by the jack-up rig the subsea production tree assemblies are installed on the multi-well subsea wellhead structure. Production can begin within months after the jack-up rig has first arrived at the well site. A floating production storage offloading vessel (FPSO) can connect to the subsea well production trees via flexible production risers. The FPSO can be leased or owned by the offshore P/NG lease operator for short or long term periods. Produced P/NG is transported to refinery installations. There is no navigation hazard for the well production location, after the FPSO has been moved away from the drill site, because everything is located subsea. There is no storm or adverse weather hazard for the well production location since the production equipment is located at or near the seabed. There is a significantly reduced pollution hazard for the well production location. There is no fire or explosion hazard for the wellhead tree location at the seabed. In the unlikely event of a well breach, the incidence of rig fires and subsequent major damage, or even loss, of the drilling vessel is greatly reduced by locating the production equipment of the wells at the seabed. There is a reduced personnel risk for well production employees on location because the wellheads of the well or wells are located at the seabed. There is no premises liability risk for unauthorized persons at the production because the offshore location of the production site prohibits unauthorized persons to gain access to the production site. There is no terrorist/criminal risk for the well production location because of the difficulty finding the production location unless the FPSO or SEDU are located at the production site. Even then unauthorized persons would experience difficulties accessing the FPSO or SEDU due to the presence of workers and security personnel.

Safety:

The SEDU that is utilized for drilling in water depths at, or less than, 600' of water depth is actually safer than drilling with floating drill ships and semi-submersibles. The bending moment induced on the wellhead by a floating rig is a significant hazard in depths of 600' or less. The loss of proper station keeping by the floating rig will likely cause damage to the subsea wellhead. The jack-up rig stands on the seabed and is therefore considered to be stationary. Wind and wave loads would need to be factored into the overall well construction plan, particularly in water depths exceeding 400'. Harsh environment rated jack-up rigs that can operate in 450' of water depths are available for use at the present time.

Economic Considerations:

The time period between the first discovery of economically viable deposits of P/NG offshore in shallow water and first production of same is greatly reduced by the use of subsea wells drilled by a jack-up rig. This time period is reduced from about three years at best by conventional surface production means to only months by subsea means and methods. The conventional bottom standing structure for shallow water production is expensive and time intensive. The engineering, procurement, fabrication and installation of these structures is an expense that can be alleviated by subsea production facilities in shallow water. The overall maintenance of the offshore production location is greatly reduced. Many significant risks are eliminated or controlled. Lower risks mean lower risk management costs for the installation owner/operator. The risk of labor interruption at the offshore production location is transferred to FPSO operation. Fire, explosion, toxic exposure, pollution and terrorist/criminal hazards are also transferred generally to FPSO operation. Once the P/NG reserves are depleted at the offshore location, the decommissioning costs are considerably diminished. There is minimal environmental impact at the well site. The offshore market trends that are leading to subsea production in shallow water are currently developing rapidly. The subsea wellhead and equipment makers are developing installation, operation and maintenance business models for offshore P/NG lease owner/operators. The reuse of subsea production trees is a significant saving factor for larger offshore subsea locations.

Summary:

The use of SEDU's for drilling P/NG wells with subsea wellheads is a valuable innovation. The drilling of the shallow water wells would be much safer for the offshore personnel, the drilling vessel itself and the assets on board the vessel. Without the presence of the offshore structure above mean sea level, the environmental impact of the drilling and production activities would be undeniably less than it is at the present time. Additionally, the decommissioning of the offshore location is markedly simpler. The overall efficiency of development of oil and gas reserves in this manner is economically attractive to offshore lease operators, drilling rig owners and subsea equipment manufacturers. The time savings of this method, coupled with the safety, responsible environmental practices and cost effective characteristics certainly promote the sustainability of using jack-up rigs to drill subsea wells.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A method for employing a self-elevating drilling unit (SEDU) for drilling and completing a subsea well in a marine environment having a water surface and a seabed, said SEDU having a vessel hull, a plurality of moveable vessel support legs of sufficient length to extend from said vessel into the seabed for lifting the vessel hull a desired height above the water surface and having a cantilevered housing projecting laterally from said vessel hull and positioning a derrick and well drilling system supported by said cantilevered housing for well drilling, said well drilling system having a rotary drilling table within said cantilevered housing and in alignment with said wellhead, said rotary drilling table having a central opening, said method comprising:

providing a well installation having a conductor pipe penetrating a desired depth into a seabed and having a wellhead permanently located at the seabed;

positioning said SEDU with said derrick and rotary drilling table of said cantilevered housing above the water surface and in alignment with said wellhead;

positioning a blowout preventer (BOP) stack having a plurality of connected BOP units within said cantilevered housing and being moveable within said cantilevered housing for alignment with said rotary drilling table;

providing multiple drilling spools each having upper and lower connection flanges and each having an internal circular spool handling groove therein;

securing a wellhead connector member to the lower end connection flange of said lower drilling spool;

positioning a drilling spool running tool within said lower drilling spool and establishing handling engagement with said internal circular spool handling groove thereof and lowering said lower drilling spool within said central opening of said rotary drilling table;

supporting said lower drilling spool relative to said rotary drilling table with a spider mechanism;

with said drilling spool running tool engaging said internal circular groove of successive drilling spools and connecting them in end to end relation forming a drilling spool string having plurality of tubular drilling spools in sealed and pressure containing relation;

connecting said wellhead connector to said wellhead connecting an uppermost tubular drilling spool of said drilling spool string with said BOP stack; and drilling and completing said subsea well through said BOP stack, said drilling spool string, said wellhead connector and said wellhead.

2. The method of claim 1, comprising:

engaging said internal groove with a plurality of locking dogs that are extended from retracted positions to locking positions from said drilling spool running tool;

hoisting and handling said tubular drilling spools with said drilling spool running tool and said elevator mechanism for assembly and disassembly of said drilling spool string; and releasing said drilling spool running tool from said tubular drilling spool being hoisted and handled by retracting said plurality of locking dogs from said internal circular groove.

3. The method of claim 1, comprising:

following said steps of drilling and completing said subsea well releasing said wellhead connector from said wellhead;

releasing said BOP stack from said drilling spool string;

separating said drilling spool string into sections each having at least one drilling spool, the lowermost drilling spool section having said wellhead connector mounted thereto;

hoisting said drilling spool string sections through said central opening of said rotary drilling table leaving said wellhead in place at the seabed; and storing said drilling spool sections in readiness for subsequent subsea well drilling and completion.

4. Apparatus for drilling and completing a subsea well having a conductor pipe extending to a desired depth within a seabed and having a wellhead located at the seabed, comprising:

a self-elevating drilling unit (SEDU) having a vessel hull, a plurality of moveable vessel support legs of sufficient length to extend from said vessel hull and into the seabed for lifting said vessel hull a desired height above the water surface;

a cantilevered housing projecting laterally from said vessel hull and having a derrick having a well drilling mechanism and an elevator mechanism;

a rig floor being located on said cantilevered housing and defining a drilling opening, said cantilevered housing having moveable support and positioning apparatus below said rig floor providing support for well drilling apparatus and being selectively moveable fore, aft, port, and starboard for positioning said well drilling apparatus in alignment with said drilling opening within said cantilevered housing;

a rotary table being positioned at said drilling opening of said rig floor and having a rotary table opening through which well drilling operations are conducted;

a blowout preventer stack being located within said cantilevered housing and being supported and positioned for well drilling operations by said moveable support and positioning apparatus;

a plurality of well drilling spools being mounted end to end and forming a drilling spool string having a length for extending from said blowout preventer stack to said subsea wellhead;

each of said plurality of well drilling spools having an internal circular drilling spool handling groove;

a drilling spool running tool being positionable within selected well drilling spools and in drilling spool handling engagement with said internal circular drilling spool handling groove and being moveable to position the selected well drilling spool in end to end relation with another well drilling spool of said well drilling string for connection therewith; and a wellhead connector being mounted to said well drilling spool string and being hydraulically actuated for locking and releasing relation with said subsea wellhead.

5. The apparatus for drilling and completing a subsea well of claim 4, comprising:

each of said well drilling spools of said well drilling spool string being connected in a stud by flange configuration and having a central tubular member;

upper and lower flange members each having tubular sections connected with respective ends of said central tubular member by full penetration welds and having annular flanges each defining a circular seal seat receiving a circular metallic seal and having a plurality of internally threaded openings each having a connection stud therein securing flange members of adjacent drilling spools in sealed pressure containing assembly with one another, with a blowout preventer and with said wellhead connector, said tubular section of each of said upper flange members defining said internal circular drilling spool handling groove.

6. The apparatus for drilling and completing a subsea well of claim 4, comprising:

said well drilling spool running tool being selectively hoisted and lowered by said elevator mechanism of said derrick and having a plurality of locking dogs being selectively extended laterally into said internal circular drilling spool handling groove to permit hoisting and handling of said well drilling spool string or individual well drilling spools and being selectively retracted from said circular internal well drilling spool handling groove to separate said drilling spool running tool from said well drilling spool.

7. The apparatus for drilling and completing a subsea well of claim 6, comprising:

said well drilling spools each having a cylindrical internal wall surface of a predetermined dimension defining a through passage thereof permitting well drilling tools to be passed therethrough;

said well drilling spool running tool having a tool body dimensioned for movement into said through passage of said well drilling spool and having a hydraulic piston actuator selectively moving said locking dogs to said extended and contracted positions; and a hydraulic system receiving pressurized hydraulic fluid from a controllable hydraulic source and selectively conducting said pressurized hydraulic fluid to said hydraulic piston actuator for selective actuation of said locking dogs to said extended or contracted positions.

8. The apparatus for drilling and completing a subsea well of claim 7, comprising:

said tool body of said well drilling spool running tool defining an upwardly facing internally threaded drill pipe box connection;

a lifting stem having an externally threaded pipe pin connection being selectively threaded into said drill pipe box connection of said tool body for selective hoisting or lowering said drilling spool running tool relative to said drilling spool; and said lifting stem having an upper end defining an upwardly facing internally threaded drill pipe box connection facilitating connection of a length of drill pipe thereto as needed for selective positioning of said well drilling spool relative to said subsea wellhead.

9. The apparatus for drilling and completing a subsea well of claim 4, comprising:

a short length drilling spool having a mounting flange at its lower end and a studded connection flange at its upper end being connected by bolting to the top of said wellhead connector and having sufficient length to accommodate a retrievable test plug; and a string of longer length drilling spools being joined with said short length drilling spool to span the vertical distance from said wellhead connector to the bottom connector of said BOP stack; and said BOP stack being located above the sea surface in a chamber formed within said cantilevered housing and below said rig floor.

10. Apparatus for drilling and completing a subsea well having a conductor pipe extending to a desired depth within a seabed and having a wellhead located at the seabed and a blowout preventer located on a marine well drilling vessel, comprising:

a first wellhead connector being mounted to said wellhead;

a bottom well drilling spool having a second wellhead connector connected with the bottom end of said bottom well drilling spool and being selectively connected to and disconnected from said first wellhead connector;

a top well drilling spool being connected with said blowout preventer;

a plurality of intermediate well drilling spools being connected in end to end relation and together with said bottom and top well drilling spools defining a pressure containing tubular well drilling spool string through which well drilling operations are conducted;

each of said top, bottom and intermediate well drilling spools defining an internal passage and having a circular well drilling spool handling groove therein;

a drilling spool running tool being selectively positioned within said internal passage of a selected well drilling spool and having spool handling engagement within said drilling spool handling groove; and a derrick and elevator mechanism being mounted to said marine well drilling vessel, said elevator mechanism being selectively connected with said drilling spool running tool and selectively lifting and lowering said drilling spool running tool and said selected well drilling spool or drilling spool string for well drilling and for connecting and disconnecting said first and second wellhead connectors.

11. The apparatus for drilling and completing a subsea well of claim 10, comprising:

each of said top, bottom and intermediate well drilling spools having a central tubular member;

upper and lower connection flange members each having tubular sections being connected with respective ends of said central tubular member by full penetration welds;

said upper connection flange member defining an internal circular drilling spool handling groove within said tubular section thereof; and a plurality of selectively moveable locking dogs being extendable and retractable from said drilling spool running tool and being selectively actuated for engaging within said internal circular spool handling groove to lock said drilling spool running tool to a selected well drilling spool for hoisting, lowering and handling thereof and to retract said plurality of moveable locking dogs from said internal circular groove to release said drilling spool running tool from said selected well drilling spool.

12. The apparatus for drilling and completing a subsea well of claim 10, comprising:

said drilling spool running tool having a running tool body having a hydraulic piston therein being connected for selective extension and retraction movement of said plurality of locking dogs and having a hydraulic system connected in extend and retract relation with said hydraulic piston;

an internally threaded upwardly facing box drill pipe connection being defined by said running tool body;

a lifting stem having a central tubular section and having a lower end section defining an externally threaded pipe pin connection being in threaded engagement within said internally threaded upwardly facing box drill pipe connection; and said lifting stem having an upper end section defining an internally threaded upwardly facing box drill pipe connection to which an externally threaded pin connection of a length of drill pipe is received enabling raising and lowering of a well drilling spool string to which said drilling spool running tool is selectively connected by actuation of an elevator mechanism of said marine well drilling system.

13. The apparatus for drilling and completing a subsea well of claim 10, comprising:

said body of said drilling spool running tool defining a downwardly facing stop shoulder disposed for engagement with an upper surface of an upper connection flange of a selected well drilling spool limiting penetration of said running tool body into said through passage of said well drilling spool and positioning said locking dogs in alignment with said internal circular spool handling groove.

14. The apparatus for drilling and completing a subsea well of claim 11, comprising:

a buoyancy module composed of syntactic foam being secured about each of said well drilling spools of said well drilling spool string and providing a buoyant force offsetting the weight of each well drilling spool section of said well drilling spool string.

15. The apparatus for drilling and completing a subsea well of claim 14, comprising:

a buoyancy module being positioned about each of said well drilling spools and defining external bolt receptacles; and retainer bolt members being located within said external bolt receptacles and securing said buoyancy modules in assembly about said well drilling spools.

* * * * *